United States Patent [19]

Sumiyoshi et al.

[11] 4,235,210

[45] Nov. 25, 1980

[54] FUEL SUPPLY APPARATUS FOR INTERNAL COMBUSTION ENGINES

[75] Inventors: Masaharu Sumiyoshi; Setsuro Sekiya; Katsuhiko Motosugi, all of Toyota; Junzo Uozumi, Nagoya; Tsuneo Ando, Chiryu; Yuzo Takeuchi; Mikio Minoura, both of Nagoya, all of Japan

[73] Assignees: Toyota Jidosha Kogyo Kabushiki Kaisha, Toyota; Aisan Industry Co., Ltd., Ohbu, both of Japan

[21] Appl. No.: 900,507

[22] Filed: Apr. 27, 1978

[30] Foreign Application Priority Data

May 4, 1977 [JP] Japan ..... 52-51555

[51] Int. Cl.[3] ..... F02B 3/00; F02M 69/04

[52] U.S. Cl. ..... 123/471; 123/470; 239/404

[58] Field of Search ..... 123/139 AW, 28, 29; 239/404

[56] References Cited

U.S. PATENT DOCUMENTS

| | | | |
|---|---|---|---|
| 1,474,603 | 11/1923 | Morse | 239/404 |
| 1,615,457 | 1/1927 | Jorgensen | 239/404 |
| 1,684,488 | 9/1928 | Haeusser et al. | 239/404 |
| 1,777,141 | 9/1930 | Howden | 239/404 |
| 2,379,161 | 6/1945 | Kraps | 239/404 |
| 2,592,297 | 4/1952 | Laguilharre | 239/404 |
| 2,876,756 | 3/1959 | Gold et al. | 123/139 AW |
| 3,383,049 | 5/1968 | Guerin | 239/404 |
| 4,159,703 | 7/1979 | Mayer | 123/139 AW |

FOREIGN PATENT DOCUMENTS

| | | | |
|---|---|---|---|
| 896738 | 6/1954 | Fed. Rep. of Germany | 123/28 |
| 1230611 | 12/1960 | Fed. Rep. of Germany | 123/28 |
| 2319034 | 4/1973 | Fed. Rep. of Germany | 123/28 |
| 452762 | 8/1949 | Italy | 239/404 |
| 631082 | 10/1949 | United Kingdom | 239/404 |
| 1161497 | 8/1969 | United Kingdom | 123/139 AW |

*Primary Examiner*—Wendell E. Burns

*Attorney, Agent, or Firm*—Cushman, Darby & Cushman

[57] ABSTRACT

In a fuel supply apparatus for an internal combustion engine, a fuel discharging apparatus includes a fuel discharge port opened in an air intake conduit and a fuel valve for injecting a controlled quantity of fuel into the air intake passage through the discharge port. An annular fuel whirling chamber is formed around the fuel valve to receive fuel flow in a tangential direction to cause the fuel flow to whirl within the annular chamber. On the other hand, an annular recess is formed in a passage communicating the discharge port and the fuel valve with each other to forcively feed air to the fuel flowing through the passage. The fuel is thus intensively mixed with air and can be easily atomized upon being injected into the air intake passage through the discharge orifice.

7 Claims, 7 Drawing Figures

FUEL SUPPLY APPARATUS FOR INTERNAL COMBUSTION ENGINES

The present invention relates to a fuel supply apparatus for an internal combustion engine and in particular to a fuel discharging apparatus for discharging fuel into an air intake conduit of the engine in a fine particulate state to promote the atomization of fuel upon injection into the air intake conduit.

Heretofore, a fuel supply apparatus of the carbureter type has been widely adopted in gasoline internal combustion engines by virture of relatively simple and inexpensive structure thereof. On the other hand, a fuel supply apparatus of the injection type is of a relatively complicate and expensive structure. Nevertheless, the injection type fuel supply apparatus has been recently employed increasingly in the gasoline engines in view of the advantage that the fuel supply apparatus of this type permits fuel quantity to be controlled with a high accuracy and thus facilitates the control of air-fuel ratio so as to minimize air-pollutants in exhaust gases thereby conforming to rather severe exhaust gas regulations as statutely required. However, the injection type fuel supply apparatus suffers from a problem. That is, the atomization of fuel injected into the air intake conduit can not be effected in a satisfactory manner as compared with the carbureter type fuel supply apparatus. It is thus highly desirable to solve this problem. A similar problem will exist also in the fuel supply apparatus of the carbureter type particularly in the idle operation of the engine. The atomization of the fuel injected from the idle port during the idle operation remains unsatisfied.

An object of the invention is to provide a fuel supply apparatus for an internal combustion engine which is evaded from the drawbacks of the hitherto known fuel supply apparatus as described above.

Another object of the invention is to provide a fuel discharge apparatus which allows fuel injected into an air intake conduit of an internal combustion engine to be atomized to a satisfactory degree.

Still another object of the invention is to provide a fuel discharge apparatus which can be adopted in a fuel supply apparatus whether of the fuel injection type or carbureter type.

Further object of the invention is to provide a fuel discharge apparatus which can be implemented inexpensively in a simplified structure and still can be operated with a high accuracy and reliability.

In view of the above and other objects which will become more apparent as description proceeds, there is provided according to the present invention a fuel discharge apparatus which comprises a fuel control means for delivering a controlled quantity of fuel, a fuel discharge port communicating with said fuel control means through a fuel passage and opened to an air intake passage leading to an internal combustion engine, at least one air inlet port opened to said fuel passage, means for supplying air through said air inlet port to said fuel passage, and means for forcing air supplied to said fuel passage to impinge against fuel flowing through said fuel passage at a high velocity relative to the fuel flow. With such arrangement of the fuel discharge apparatus, the fuel flowing toward the discharge port from the fuel control means is broken into fine fuel particles due to the intensive impingement of air stream and thus discharged into the air intake conduit in a fine particulate state. It is thus possible to attain a satisfactory atomization of fuel injected into the air intake conduit.

According to another feature of the invention, it is preferred that an annular fuel whirling chamber is formed coaxially with and around the fuel control means at the inlet side thereof with a fuel inlet port positioned so as to introduce the fuel into the annular chamber in the direction tangential to the circumference thereof. By virtue of such arrangement, the fuel flowing from the fuel control means is revolved whereby the mixing with air on the way toward the discharging port can be significantly promoted.

In a preferred embodiment of the invention, an annular recess or groove is formed integrally and concentrically with the passage leading to the discharge orifice and air is introduced into the annular recess through at least an air inlet port in a direction tangential to the circumference of the annular recess and opposite to the direction in which the fuel is introduced into the annular fuel whirling chamber. According to this feature of the invention, maximum relative velocity can be attained between the air stream and the whirling fuel stream flowing toward the discharging port, whereby the fuel can be more intensively intermingled with air under favorable condition that the whirling or revolving directions of air and fuel streams are opposite to each other, involving ultimately an optimum fuel atomization. According to a still further feature of the invention, the air stream may be applied to the fuel stream in a form of cylindrical thin film in the direction orthogonal to the latter. In this case, it is possible to obtain substantially similar advantages as the former case.

The present invention involves many other advantages. For example, due to the improved atomization of fuel, distribution of fuel among the engine cylinders can be improved to reduce fuel deposition on the inner wall of the air intake conduits. Additionally, the operation performances of the engine at a low temperature will be significantly enhanced, whereby fuel consumption can be decreased. Further, transient response characteristics of engines can be also improved to make it unnecessary to heat associated risers. Of course, operation performances in an idle operation as well as in a low load operation will be advantageously improved.

In conjunction with the description of the invention, the term fuel control means as used herein is intended to mean a valve or similar part which is disposed near to the air intake passage or conduit and serves to control or adjust a quantity of fuel flowing toward the discharge port opened in the air intake conduit. Accordingly, the term "fuel control means" should be interpreted to encompass and intermittent fuel injection valve of a fuel supply apparatus of the fuel injection type, a restriction means adjustable by means of an idle adjusting screw in the carbureter type fuel supply system and any other means which falls within the purview of the above definition.

The above and other objects, features and advantages of the invention will become more apparent from the description of exemplary embodiments taken in conjunction with the accompanying drawings.

Figure 1:
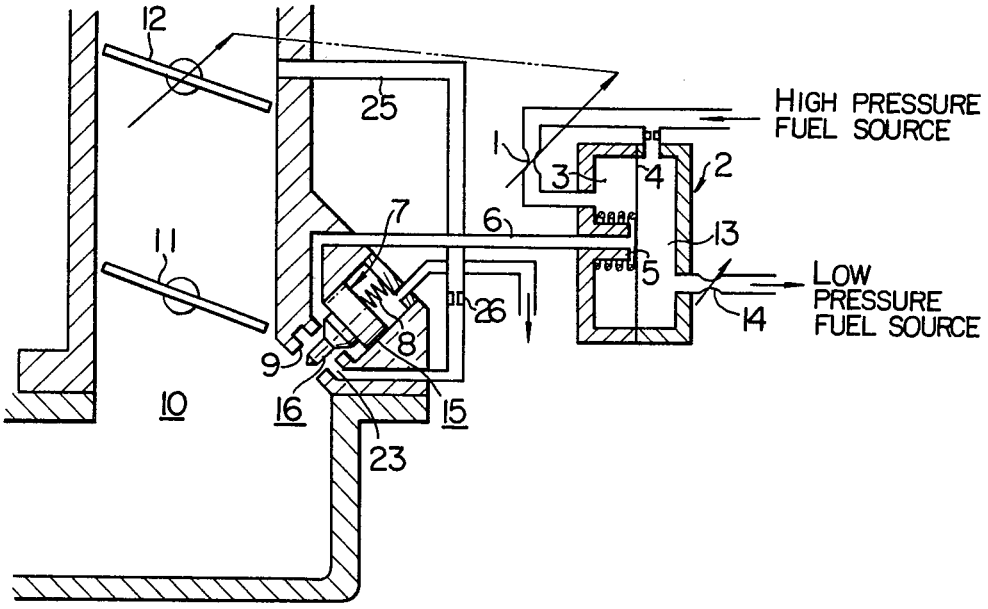
FIG. 1 shows a schematic sectional view of a general arrangement of a fuel supply apparatus of a fuel injection type to which the principle of the invention is applied.

FIG. 1 shows schematically a fuel supply apparatus of continuous fuel injection type to which the invention is applied. An example of such type fuel supply apparatus is disclosed in Japanese Patent Application No. 48930/1977 which corresponds to our U.S. application Ser. No. 900,011, filed Apr. 25, 1978, and to which reference will be herein made for a better understanding of the principle of the invention. Referring to FIG. 1, fuel is fed from a high pressure fuel supply source maintained at a predetermined high pressure through a fuel metering valve 1 into a first pressure chamber 3 of a fuel differential pressure apparatus 2. There is disposed a constant differential pressure valve in the first pressure chamber 3, which valve is constituted by a diaphragm 4 and a valve seat 5 positioned in opposition to the diaphragm 4 and serves to supply the fuel from the first pressure chamber 3 to a fuel valve 7 at a predetermined pressure through a passage 6. The fuel valve 7 is opened against the force of a spring 8 when the pressure supplied through the passage 6 has attained a predetermined level, whereby the fuel is injected through a fuel discharge port 9 into an air intake conduit 10 downstream of a throttle valve 11 disposed therein. The quantity of fuel injection is adjusted so as to be compatible with the quantity of intake air by means of the fuel metering valve 1 which is operationally interlocked with an air valve 12 disposed in the air intake conduit 10 upstream of the throttle valve 11, as is described in detail in Japanese Patent Application No. 48930/1977 referred to above. Further, with a view to correctively controlling the air-fuel ratio in dependence on the operating conditions of an associated internal combustion engine, the differential pressure apparatus is further provided with a second pressure chamber 13, whose pressure is adjusted by an adjusting valve 14, thereby to correctively adjust the fuel pressure controlled by the constant differential pressure valve constituted by the diaphragm 4 and the valve seat 5.

Figure 2:
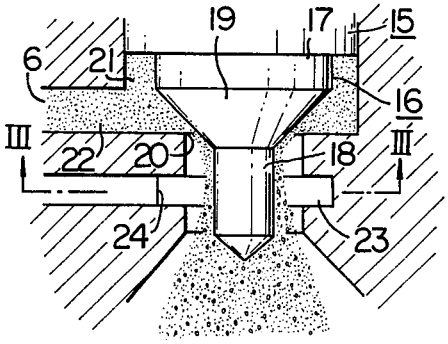
FIG. 2 is a fragmental enlarged view of a main portion of FIG. 1.

The fuel valve 7 includes a piston 15 which is usually urged toward the closed position under the influence of the spring 8 and a valve element or core 16 extending from the piston 15 into the fuel discharge port 9. More specifically, the valve element or core 16 is composed of a cylindrical base portion 17 of a large diameter, a point portion 18 of a small diameter and an intermediate frusto-conical portion 19 which is adapted to seat on a valve seat 20, as is more clearly shown in FIG. 2. Formed around the core 16 at the inlet side of the valve seat 20 is a fuel whirling chamber 21 which is defined by the inner wall of the cylinder accommodating slidably the piston 15 therein. A fuel inlet port 22 is formed in the peripheral wall of the fuel whirling chamber 21 at the lower portion thereof and opened in the chamber 21 in the direction tangential to the circumference thereof, as can be seen from FIGS. 3 and 4. Further, an annular recess or groove 23 is formed concentrically around the fuel passage between the valve seat 20 and the fuel discharge orifice 9. An air inlet port 24 is formed in the peripheral wall of the annular groove 23. The air inlet port 24 may be so located that air can be introduced into the annular recess 23 in the direction tangential to the circumference thereof at the opposite side relative to the fuel inlet port 22. Alternatively, the air inlet port 24 may be so positioned as to supply air into the annular groove 23 in the radial direction thereof, as is shown in FIG. 4. Two, three or more air inlet ports may be provided, if necessary. The air flow to be introduced into the annular recess 23 may be available from the air intake conduit 10 upstream of the air valve 12 where the atmospheric pressure prevails or upstream of the throttle valve 11 under the differential pressure appearing across these valves. To this end, an air conduit 25 can be provided in a manner shown in FIG. 1 with a flow restriction 26 for adjusting the air flow.

With the arrangement as described above, it is now assumed that the fuel valve 7 is opened in response to a predetermined pressure of fuel supplied through the passage 6. Then, the fuel supplied through the passage 6 will flow into the fuel whirling chamber 21 through the fuel inlet port 22 in the direction tangential to the circumference of the chamber 21 and revolve or whirl around the valve element or core 16 of the fuel valve 7, to finally flow toward the fuel discharge port 9 in a form of cylindrical thin film after having passed through an annular gap between the valve seat 20 and the frusto-conical portion of the core 16. On the other hand, due to suction effect produced by the high speed fuel flow and the differential pressure appearing across the air valve 12 and the throttle valve 11, air is introduced into the annular groove 23 at a high speed through the passage 25 from the air intake conduit 10 upstream of the air valve 12 and caused to mix intensively with the fuel stream. In the case of the arrangement shown in FIG. 3, the suction air from the air inlet port 24 is at first caused to revolve around the valve core 16 in the annular groove 23 in the direction opposite to that of the fuel flow. Thus, there will take place intensive or impulsive intermingling impingement between the fuel flow and air flow. In the case of the arrangement shown in FIG. 4, the air stream can flow into the annular groove 23 in the direction perpendicular to the whirling fuel flow to be intensively mingled with the latter. As a result of the impulsive feeding of air, the fuel is broken into fine particles, whereby the particulate fuel is easily atomized upon being injected into the air intake conduit 10 from the fuel discharge port 9. The revolving or whirling flow of the fuel is very effective not only in attaining the intensive mixing with the air flow but also in promoting the formation of fine fuel particles by lengthing the fuel flow path to the fuel discharge port 9. Further, the annular groove 23 is advantageous in that the space in which the intermingling of fuel and air can take place is correspondingly expanded by the groove 23, which in turn will promote the generation of the particulate fuel.

Figure 4:
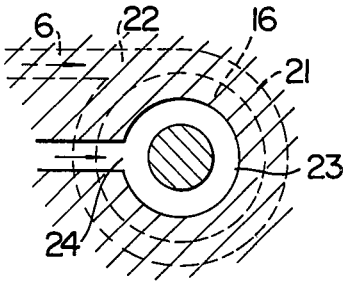
FIG. 4 is a view similar to FIG. 3 and shows a modified arrangement thereof.
Figure 5:
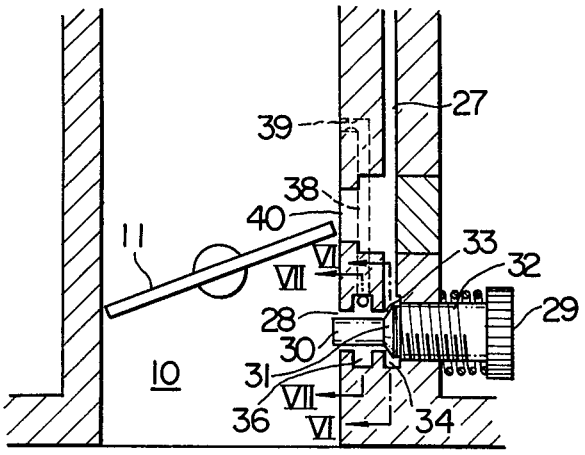
FIG. 5 is a schematic sectional view showing a general arrangement of a fuel supply apparatus of a carbureter type having an idle port to which the teachings of the invention is applied.
Figure 6:
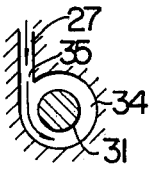
FIG. 6 is a sectional view taken along the line VI—VI in FIG. 5, and, FIG. 7 is a sectional view taken along the line VII—VII in FIG. 5.
Figure 7:
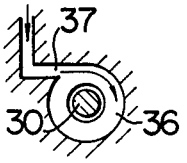

FIGS. 5 to 7 show by way of example an idle port of a fuel supply apparatus of a common carbureter type to which the teachings of the invention are applied. As is well known, when the engine is operated in an idling mode with the throttle valve 11 being closed, a part of fuel in a float chamber (not shown) is fed to the fuel discharge port, i.e. an idle port 28 in the case of the illustrated embodiment through a slow fuel passage 27 and discharged into the intake conduit 10 under a considerably high negative pressure prevailing then downstream of the throttle valve 11. The fuel quantity discharged from the idle port 28 can be adjusted by an idle adjusting screw 29. The idle adjusting screw 29 has a core 30 projecting concentrically into the idle port 28 and connected to the forward end of the threaded portion 32 of the idle adjusting screw 29 through an intermediate frustro-conical portion 31. A gap defined between the frustro-conical portion 31 of the idle adjusting screw 29 and an inlet 33 to a passage leading to the idle port 28 constitutes a flow restriction which corresponds to the fuel valve in the sense as defined hereinbefore. Formed coaxially in the peripheral surface of the frustro-conical portion 31 of the idle adjusting screw is a whirling flow chamber 34 in which an inlet port 35 for the fuel supply from the slow fuel passage 27 is opened in the direction tangential to the circumference of the fuel whirling chamber 34, as is shown in FIG. 6. Further, an annular groove 36 is formed coaxially around a passage between the flow restriction 33 and the idle port 28. As can be seen from FIG. 7, an air inlet 37 is formed in the peripheral wall of the annular groove 36 so as to feed air in the direction tangentially to the circumference of the annular groove 36 at the opposite side relative to the fuel inlet 35. As is in the case of the apparatus described hereinbefore in conjunction with FIGS. 1 to 4, the air inlet 37 is communicated with the intake conduit 10 through a passage 38 upstream of the throttle valve 11. The passage 38 is provided with a restriction 39. Reference numeral 40 denotes slow port for supply at a low speed operation mode of the engine.

Figure 3:
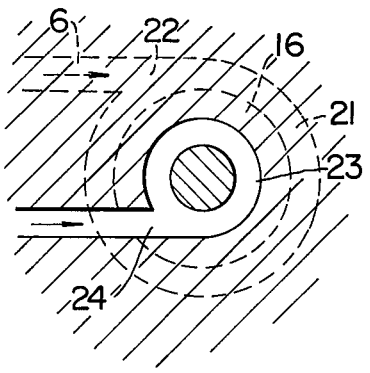
FIG. 3 is a sectional view taken along the line III—III in FIG. 2.

It will be appreciated that the fuel valve apparatus described above has substantially similar construction as the one shown in FIG. 3, wherein the fuel flow caused to revolve in the whirling chamber 34 in one direction is intensively agitated and mixed with the air stream which is also caused to whirl in the other direction within the annular groove 35 and forcively applied to the whirling fuel stream flowing toward the discharge port 28. The fuel is thus converted into the state of fine particles before being atomized upon injection into the intake conduit 10.

In the foregoing, the invention has been described with reference to the preferred embodiments. However, these embodiments are merely to illustrate the teachings of the invention that an air stream is impulsively and impingingly applied at a high relative speed to a fuel stream flowing to the fuel discharge port from the fuel valve, thereby to produce fine particles of fuel to promote atomization thereof upon being injected into the intake tube. Accordingly, the invention is never restricted to the disclosed embodiments, but many modifications and variations may readily occur to those skilled in the art without departing from the spirit and scope of the invention.

What is claimed is:

1. A fuel discharge apparatus for discharging fuel into an air intake passage of an internal combustion engine, comprising a fuel discharge port opened to said air intake passage, a fuel control means for delivering a controlled quantity of fuel to said fuel discharge port through a fuel passage interconnecting said fuel control means and said fuel discharge port and means for introducing air into said fuel passage, characterized in that said fuel control means comprises a fuel whirling chamber (21; 34) coaxially disposed upstream of said fuel passage and communicating through a central opening (20; 33) with said fuel passage, a fuel control member (7; 29) axially movable with respect to said whirling chamber (21; 34) and a fuel inlet port (22; 35) provided on the peripheral wall of said whirling chamber (21; 34) for introducing fuel into said whirling chamber (21; 34) in a direction tangential to the circumference of said whirling chamber, said fuel control member (7; 29) having a frusto-conical portion (19; 31) coaxially disposed within said whirling chamber (21; 34) for cooperating with said central opening (20; 33) to control the fuel delivered from said whirling chamber (21; 34) to said fuel passage and a cylindrical core portion (18; 30) integral with said frusto-conical portion (19; 31) and projecting coaxially into said fuel passage.

2. A fuel discharge apparatus as set forth in claim 1, characterized in that an annular recess (23; 36) is formed in a cylindrical wall defining said fuel passage and at least two air inlet ports (24; 37) are opened to said annular recess (23; 36).

3. A fuel discharge apparatus as set forth in claim 2, characterized in that said air inlet port (24; 37) is provided on the peripheral wall of said annular recess (23; 36) so as to feed air into said recess in a direction tangential to the circumference of said annular recess (23; 36) and opposite to the direction in which fuel is introduced into said whirling chamber (21; 34).

4. A fuel discharge apparatus as set forth in claim 2, characterized in that said air inlet port (24) is provided on the peripheral wall of said annular recess (23) so as to feed air into said recess in a radial direction thereof.

5. A fuel discharge apparatus as set forth in claim 1, wherein said air intake passage is provided with a throttle valve therein, characterized in that air to be introduced into said fuel passage is derived from said air intake passage (10) upstream of said throttle valve (11).

6. A fuel discharge apparatus as set forth in claim 1, and applied to a fuel supply apparatus of the fuel injection type, wherein said fuel control member (7) is spring loaded so as to urge said frusto-conical portion (19) towards said central opening (20).

7. A fuel discharge apparatus as set forth in claim 1 and applied to a fuel supply apparatus of the carbureter type, wherein said fuel discharge port is an idle port (28), said fuel inlet port (35) is communicated with a float chamber through a slow fuel passage (27), and said fuel control member (29) has a threaded portion (32) for adjusting the axial position of said frusto-conical portion (31) relative to said central opening (33).

* * * * *